United States Patent [19]

Polatov

[11] Patent Number: 4,856,627

[45] Date of Patent: Aug. 15, 1989

[54] WORK BRIEFCASE AND TABLE SYSTEM

[76] Inventor: Paul Polatov, 63 Buckeye Rd., Glen Cove, N.Y. 11542

[21] Appl. No.: 290,142

[22] Filed: Dec. 27, 1988

[51] Int. Cl.[4] ..... A47B 3/10

[52] U.S. Cl. ..... 190/11; 190/900

[58] Field of Search ..... 190/11, 16, 17, 10, 190/12 A, 1, 900, 901, 33, 35, 30

[56] References Cited

U.S. PATENT DOCUMENTS

| | | | |
|---|---|---|---|
| 1,005,709 | 10/1911 | Jackson | 190/30 |
| 1,223,161 | 4/1917 | Fazzini . | |
| 1,476,144 | 12/1923 | Calvert . | |
| 1,533,494 | 4/1925 | Billburg . | |
| 2,609,072 | 9/1952 | Levinson | 190/11 |
| 2,652,300 | 9/1953 | Graber et al. . | |
| 3,765,718 | 10/1973 | Chen . | |
| 3,923,356 | 12/1975 | Washburne | 190/11 X |
| 4,595,086 | 6/1986 | Simpson . | |

FOREIGN PATENT DOCUMENTS

| | | | |
|---|---|---|---|
| 394195 | 11/1908 | France | 190/11 |
| 439838 | 10/1948 | Italy | 190/11 |
| 526422 | 5/1955 | Italy | 190/11 |
| 540544 | 10/1941 | United Kingdom | 190/11 |

*Primary Examiner*—William Price
*Attorney, Agent, or Firm*—Leo Zucker

[57] ABSTRACT

A combination briefcase and table arrangement includes a set of telescoping legs mounted at the underside of a briefcase body, so that the legs support the briefcase a certain height above a floor surface when the legs are extended. The legs are stored in recessed compartments that open at the underside of the briefcase body. A set of shelves are supported in a cover portion of the briefcase, for sliding movement between a withdrawn position at which the shelves are concealed inside the cover portion, and a working position at which the shelves project from the cover portion in a plane parallel with a top surface of the cover portion. The projecting shelves and the cover portion together define a flat table surface on which papers, tools, instruments and the like carried in the briefcase, can be placed at a work site.

13 Claims, 4 Drawing Sheets

WORK BRIEFCASE AND TABLE SYSTEM

BACKGROUND OF THE INVENTION

1. Field of the Invention

The present invention relates generally to combination carrying case and table systems, and more particularly to a handy work briefcase and table system that can be easily carried to a job site, and set up in the form of a table on which articles such as blueprints, tools, instruments and the like carried in the brief-case can be conveniently placed.

2. Description of the Known Art

It is known generally to store legs within closed carrying cases so that, when the cases are opened, the legs can be extended and arranged to support the opened case as a table. For example, U.S. Pat. No. 1,476,144 issued Dec. 4, 1923, discloses a combination camp table and utensil carrier in which two table halves are hinged together and have compartments in their interiors for securing cooking and eating utensils. Each table half also has a pair of legs pivoted to opposite corners of the half by pins. The legs swing into the table halves for storage and, when extended, are locked by means of brace rods.

Another combination table and carrying case is disclosed in U.S. Pat. No. 2,652,300 issued Sep. 15, 1953. A folding table is comprised of two hinged open box members, and eating utensils are strapped into the box interiors. Legs are held in place along inside edges of the box members with blocks. The legs are extended together with table leaves that are also carried in the box members, and the legs are fixed in an upstanding position with the aid of braces provided between the leaves and the legs.

As far as is known, there has not been provided a modern day brief or attache case capable of being converted into the form of a table so that articles carried in the case, such as blueprints, tools, instruments, small samples and the like can be placed on a relatively large flat and steady surface defined by parts of the briefcase.

Such a handy briefcase/table system would be of value to, for example, persons involved in the interior design field who must travel with small tools, rulers and sample wall or floor coverings to unfinished work sites for purposes of rendering estimates. Such sites usually lack the convenience of a large table on which the various items carried to the site by the designer can be placed while estimating work is under way. Other business professionals would also find such a unit of value in fields such as sales, home repair, and office equipment service.

SUMMARY OF THE INVENTION

The present invention overcomes the shortcomings of the known art by providing a handy briefcase and table system, including a briefcase having main body and cover portions, and a set of extensible legs mounted at an underside of the body portion for supporting the briefcase a certain height above a floor surface when the legs are set at an extended position. The body portion has recessed compartments opening at the underside of the body portion, for storing the legs in a storage position. At least one shelf is supported in the cover portion, for sliding movement between a withdrawn position in which the shelf is carried inside the cover portion, and a working position in the shelf projects out from the cover portion in a plane substantially parallel with a top surface of the cover portion. The projecting shelf and the cover portion of the briefcase together define a table surface while the cover portion is closed relative to the body portion, and the legs are in the extended position.

For a better understanding of the present invention, together with other and further objects, reference is made to the following description taken in conjunction with the accompanying drawing, and the scope of the invention will be pointed out in the appended claims.

DETAILED DESCRIPTION OF THE INVENTION

Figure 1:
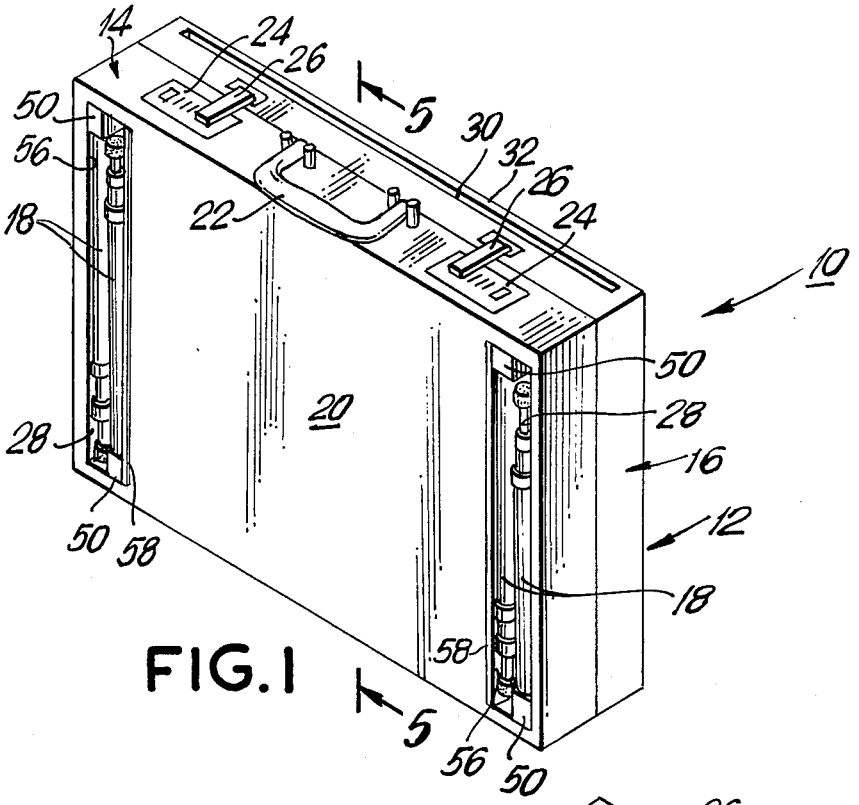
FIG. 1 is a perspective view of a handy briefcase and table system according to the invention, shown in a closed position.

FIG. 1 is a perspective view showing a briefcase and table system 10 according to the invention. The system 10 includes a briefcase or attache case 12 of the kind having a main body portion 14 and a cover portion 16 that is attached to the main body portion 14 for swinging movement between an open position (FIG. 2) and a closed position as shown in FIG. 1.

Two pair of extensible or telescoping legs 18 are mounted at the underside 20 of the briefcase 12, each pair of legs 18 being situated at opposite side end boundaries of the underside 20.

The main body portion 14 also includes a carrying handle 22 mounted for swiveling movement relative to body portion 14, and a pair of latches 24 for receiving locking ears 26 that pivot on the cover portion 16 to engage the latches 24 and lock the cover portion 16 to body portion 14, as shown in FIG. 1.

Figure 3:
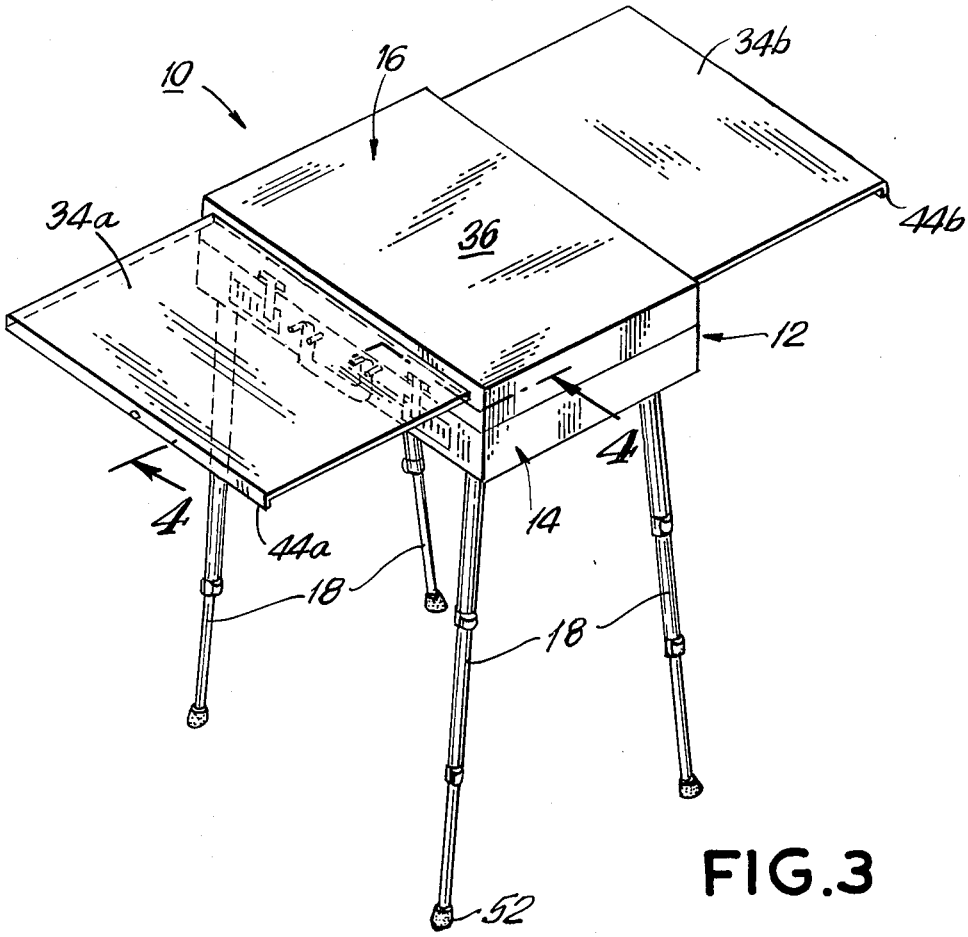
FIG. 3 is a perspective view of the present briefcase and table system showing a pair of shelves projecting out from inside the cover portion of the briefcase, and a set of legs extended from the underside of the briefcase body.

Legs 18 may be of the kind presently used for tripod camera stands, so that each leg 18 can be telescoped down to a length small enough for storage within compartment recesses 28 in the underside 20 of briefcase 12. As described below in relation to FIG. 4, each leg 18 is arranged to pivot outwardly from its associated recess 28 and telescoping sections of the leg 18 are then locked in an extended position (FIG. 3).

Cover portion 16 has an elongate slot 30 cut parallel and spaced closely to an upper long edge 32 of the cover portion 16. A corresponding elongate slot 30' (FIG. 6) is cut parallel and closely spaced to the opposite upper long edge 32' of cover portion 16. As shown in FIG. 3, a pair of shelves 34*a*, 34*b* (omitted from FIGS. 1 and 2) are supported within cover portion 16 for sliding movement between a withdrawn or stored position in which shelves 34*a*, 34*b* are carried inside the cover portion 16, and a working position, shown in FIG. 3, at which the shelves project out from inside the cover portion in a plane substantially parallel with a top surface 36 of cover portion 16. Thus, in the working position in FIG. 3, the projecting shelves 34*a*, 34*b* and cover portion 16 together define a generally flat table surface when the cover portion is closed relative to main body portion 14 of the briefcase 12, and the legs 18 are in the extended position.

Figure 2:
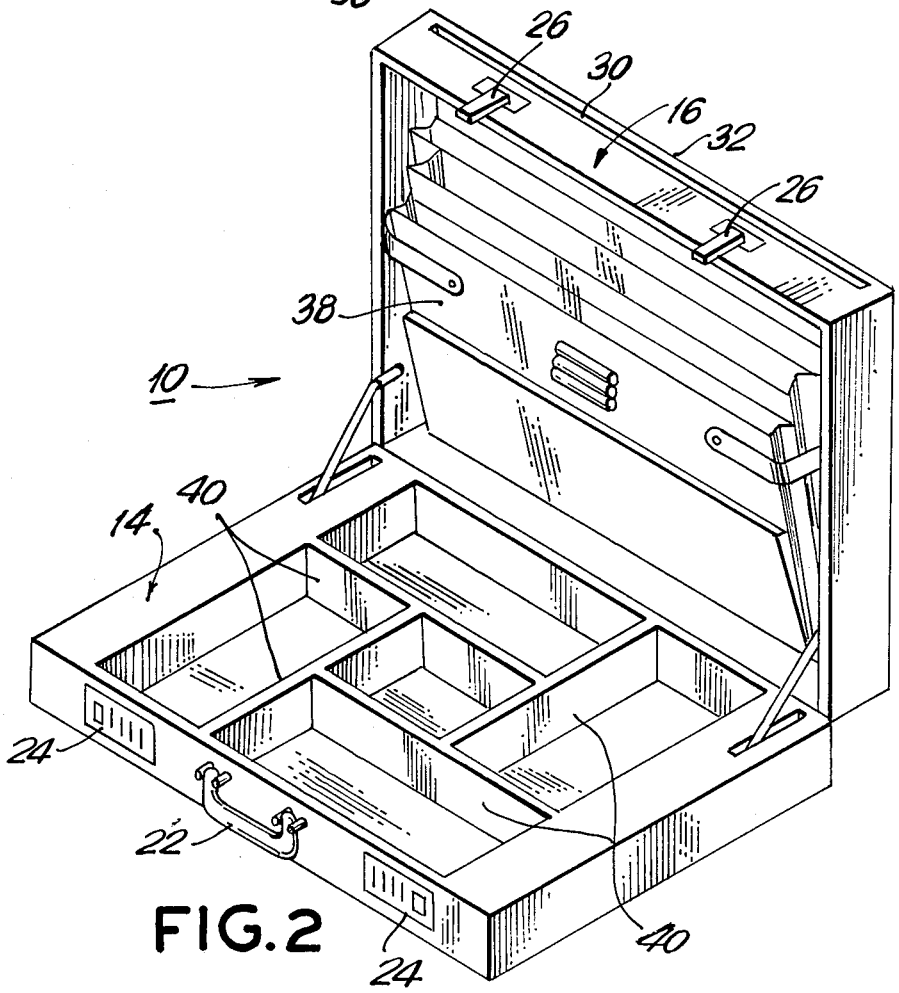
FIG. 2 is a perspective view of the briefcase/table system of FIG. 1, shown in an open position.

When the briefcase 12 is opened as in FIG. 2, various tools, instruments and the like may be placed in compartments formed in main body portion 14. Also, papers, pads, flat sample goods, pens and pencils may be stored in or on an expandable, partitioned document carrier 38 suspended within the cover portion 16.

Briefcase 12 may be constructed of any suitable materials of the kind employed for hand-carried briefcases or attache cases including, for example, plastics, wood and/or sheet metal. Any material or combination of materials that will impart sufficient rigidity to maintain the shape of the briefcase 12 when fully loaded and closed as in FIG. 1, when opened as in FIG. 2, and when converted to table form as in FIG. 3, will suffice.

Figure 4:
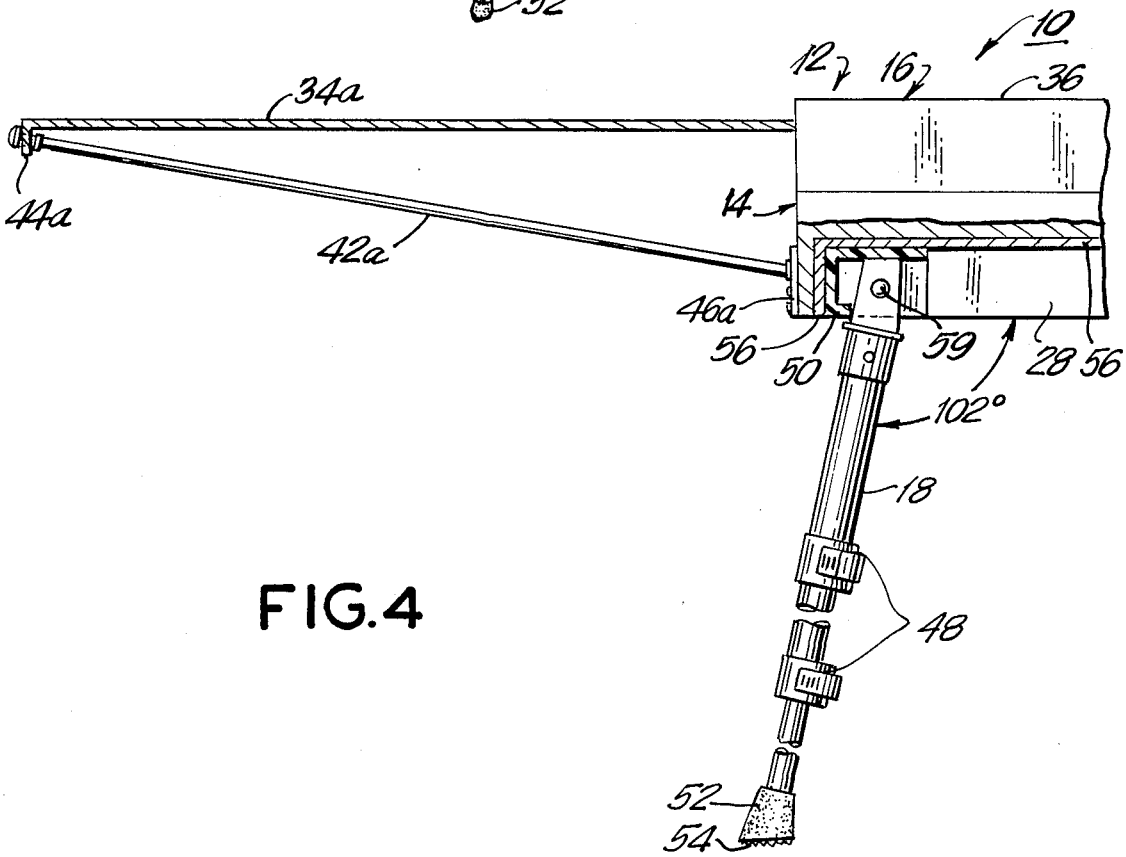
FIG. 4 is an enlarged partly sectional view as seen along line 4—4 in FIG. 3.
Figure 5:
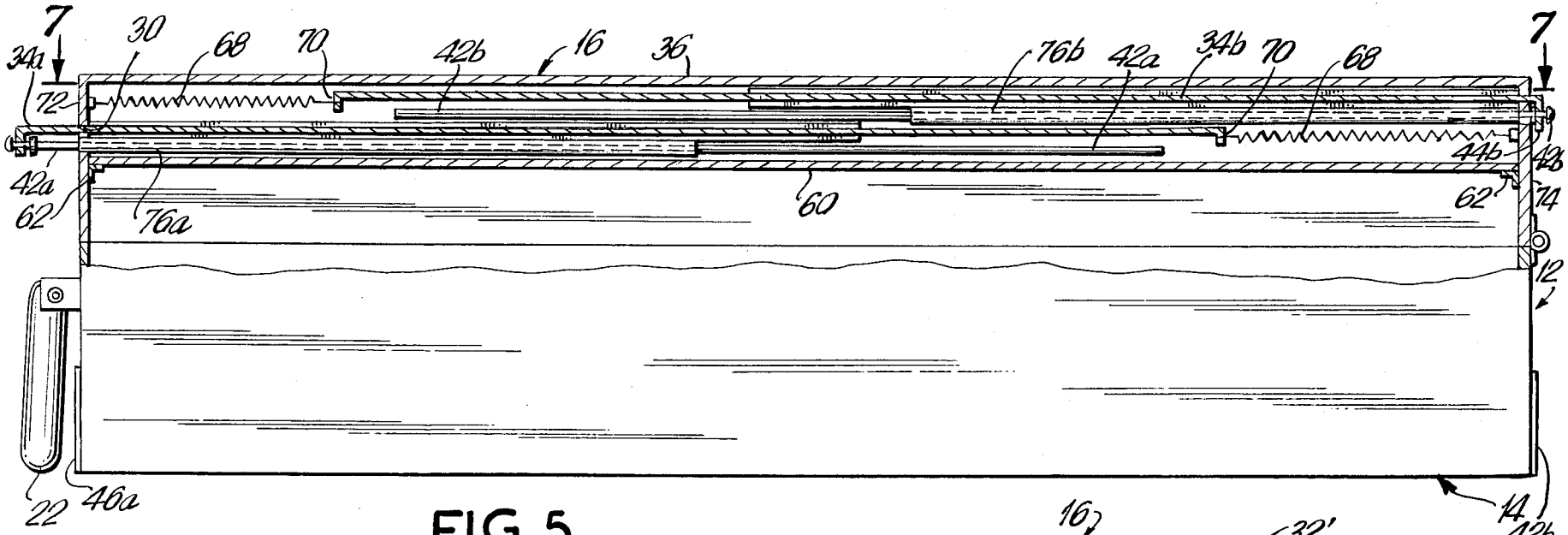
FIG. 5 is an enlarged partly sectional view as seen along line 5—5 in FIG. 1.

When the shelves 34*a*, 34*b* are pulled out from cover portion 16 to assume a working position (FIGS. 3 and 4), the shelves are supported in a horizontal plane by associated support rods 42*a*, 42*b*. As shown in FIG. 4, one end of rod 42*a* is loosely locked in the long direction about an opening in a lip 44*a*' that bends downwardly from the outside edge of shelf 34*a*. The opposite end of rod 42*a* butts against a face plate 46*a* mounted on the confronting side of the briefcase body portion 14. Face plate 46*a* preferably has a recess or dimple into which the free end of the support rod 42*a* is seated while the shelf 34*a* is in the working position. Shelf 34*b* is likewise supported in the working position by an associated support rod 42*b* one end of which is locked axially through an opening in lip 44*b* of the shelf 34*b*, and the other end of which butts against a face plate 46*b* on the confronting side of the body portion 14. See FIG. 5. Support rods 42*a*, 42*b* are preferably shorter in length than the overall depths of their associated shelves 34*a*, 34*b*.

When swung out from the recessed compartments 28 in the briefcase underside 20, each of the legs 18 can be extended to a desired height to which sets of leg section clamps 48 are tightened by the user to fix the leg lengths. It is preferred to provide some form of limiting means such as an abutment 50 in FIG. 4, so that each leg 18 swings through an angle of about 102 degrees when moved between its storage position and its extended position. Rubber feet 52 are capped on the bottom end of each leg 18 and have a bottom gripping surface 54 cut so as to run parallel with a flat floor when the leg is swung out fully as in FIG. 4. When all four legs 18 are fully extended (FIG. 3), it will be seen that a relatively steady table structure results by enabling the legs 18 to assume a spread configuration, rather than extending vertically straight which may result in instability should the shelves 34*a*, 34*b* be unevenly loaded.

In the illustrated embodiment, each pair of legs 18 are stored within, and extended from, an associated elongate rigid leg "box" 56 within which a pair of the abutments 50 are arranged at opposite ends. See FIGS. 1 and 4. Each leg box 56 is made of rigid sheet material and opens on one side thus forming the compartment recess 28 within which each pair of legs 18 are stored while the briefcase 12 is being carried about. Each leg box 56 is fixed at the corresponding location on the briefcase underside 20 by, for example, flanges 58 that are glued, riveted, or otherwise securely fixed to the main body portion 14. For the sake of a "clean" appearance, flanges 58 may extend over and be adhered to the interior of the briefcase underside 20, and corresponding rectangular bottom openings are cut in the underside 20 for registration with the open sides of the two leg boxes 56. Additional structural integrity may be obtained by joining or press fitting outer surfaces of the leg boxes 56 against surfaces of recessed walls formed underneath the main body portion 14.

Within each leg box 56, the pair of legs 18 are mounted for pivotal swinging movement so that the legs extend parallel to one another in the box recess when stored, and each leg 18 swings about an axis 59 (FIG. 4) at an opposite end of the leg box 56. Details of the mounting of the shelves 34*a*, 34*b* in briefcase cover portion 16 are shown in FIGS. 5–8.

In order to conceal the shelves 34*a*, 34*b* from view when withdrawn in the cover portion 16, and to protect the shelves and associated mechanisms from interference with articles carried in the briefcase 12, a blind panel 60 is fixed a certain distance below the top surface 36 of the briefcase. Panel 60 may be secured to inside wall surfaces of cover portion 16 by, e.g., one or more right angle support members 62 at various locations. Document carrier 38 (not shown in FIG. 5) is glued or otherwise fixed to the surface of blind panel 60 facing the main briefcase body portion 14.

When fully withdrawn in cover portion 16, each of the shelves 34*a*, 34*b* extends preferably between about three-quarters to seven-eighths of the entire depth of cover portion 16 and is guided for sliding movement by way of slotted shelf guide channels 64. Guide channels 64 can be conventional nylon or other low-friction guide members such as are commonly used in electronic printed circuit card racks. Channels 64 are fixed against the inside walls of opposite side end panels of cover portion 16 by way of, e.g., protruding stubs 66 spaced at regular intervals along the bottom of each channel 64 and snapped into corresponding recesses formed in the panel walls. See FIG. 8.

In order to provide a constant retracting force to each of the shelves 34*a*, 34*b*, to maintain the shelves in the withdrawn position when not in use, and to impart a positive seating force to the support rods 42*a*, 42*b* when the rods abut the face plates 46*a*, 46*b* in the working position, one or more biasing springs 68 are associated with each of the shelves 34*a*, 34*b*.

In the present embodiment, a pair of springs 68 are each fixed at one end to an associated inside edge 70 of each shelf. The points at which springs 68 are fixed to the associated shelf edge 70 are preferably symmetrical about the center line of sliding movement for the shelf. The other ends of the springs 68 are fixed to the inside surface of front end panel 72 for the spring pair that connects to shelf 34*b*. The other pair of springs 68 (not shown in FIG. 7) are connected at one end to the inside edge 70 of shelf 34*a*, and are connected at the other ends to the inside surface of rear end panel 74 of cover portion 16.

It is also preferred that the pair of springs 68 associated with shelf 34*a* be connected to the shelf and rear end panel 74 at points symmetrical about the center line of shelf movement, but not along the axes of movement of the springs 68 that act on shelf 34*b*. Otherwise, the springs for shelf 34*a* might interfere with the springs connected to shelf 34*b* when both shelves are pulled out from the cover portion.

Figure 6:
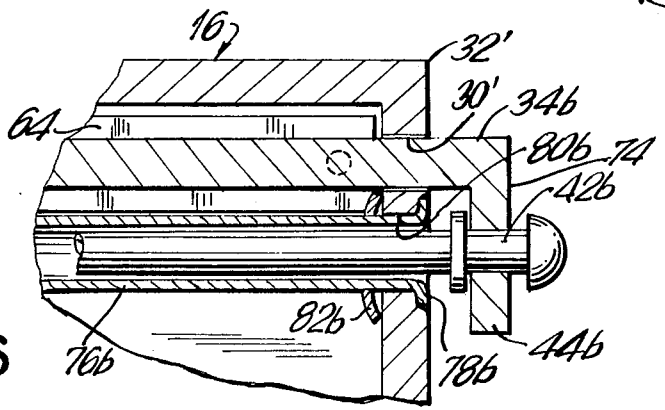
FIG. 6 is an enlarged sectional detail view of a shelf support rod storage tube arrangement shown in FIG. 5.
Figure 7:
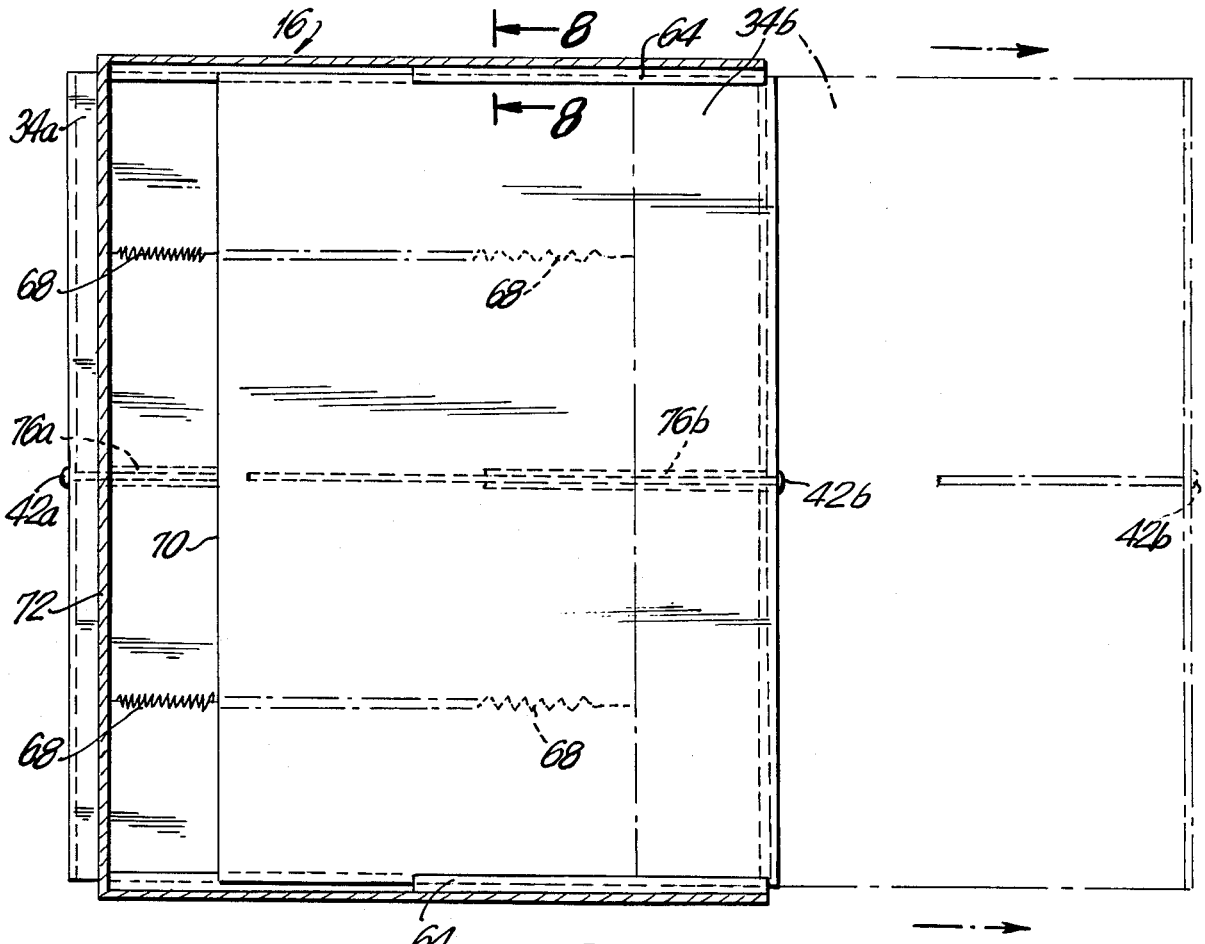
FIG. 7 is a sectional view as taken along line 7—7 in FIG. 5 and at a reduced scale.
Figure 8:
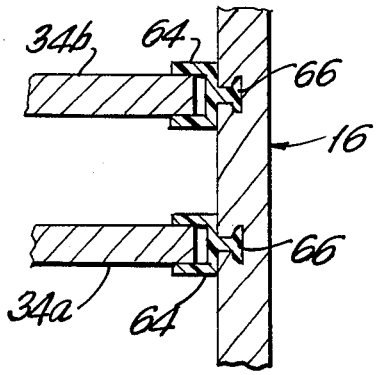
FIG. 8 is an enlarged detail view taken along line 8—8 in FIG. 7 and showing parallel shelf support guide channels fixed to an inside wall surface of the briefcase cover portion.

When the shelves 34*a*, 34*b* are in the withdrawn position, i.e., stored within cover portion 16, their associated support rods 42*a*, 42*b* are guided for axial movement by way of corresponding guide tubes 76*a*, 76*b*. See FIGS. 5–7. Each of the guide tubes 76*a*, 76*b* is preferably formed of lightweight material such as plastics or aluminum, and has a flared end such as at 78*b* in FIG. 6. Each guide tube thus may be inserted in position through corresponding openings (80*b* in FIG. 6) in the front and the rear end panels 72, 74 of the cover portion 16. Each tube is then locked in place by way of, for example, a speed nut (82*b* in FIG. 6) placed over the outer circumference of the tube and urged against the inside surface of the corresponding end panel while the flared end is held flush against the panel outside surface. As shown in FIG. 6, it is preferred that the flared end of each guide tube be seated in a recess or countersink so as to lie flush with the outside surface of end panels 72, 74.

To set the shelves 34*a*, 34*b* at the working position, they are simply pulled out from cover portion 16 against the bias force of springs 68, until the support rods drop out from the guide tubes 76*a*, 76*b*. The free ends of the support rods are then placed against the confronting face plates 46*a*, 46*b* and the shelves are released to allow the spring bias force to urge the support rods against the face plates and maintain the shelves in a steady level position as in FIGS. 3 and 4. When extended to the working position, a portion of each shelf preferably remains within cover portion 16 supported by the self guide channels 64. Such arrangement will impart the required structural integrity to allow the shelves to carry a moderate load when at the working position.

While the foregoing description represents a preferred embodiment of the present invention, it will be obvious to those skilled in the art that various changes and modifications may be made, without departing from the spirit and scope of the invention.

For example, instead of supporting the extended shelves 34*a*, 34*b* by way of rods that engage outside lips (44*a*, 44*b*) of the shelves, other bracing means that does not extend fully between the main portion 14 of the briefcase and the outside edge of each shelf, can be used. One alternate arrangement presently contemplated is the use of detachable stiff wire braces that extend between the main portion 14 and engage each shelf at about one-half the extended shelf length through an opening or groove cut in the shelf. The shelf braces could be carried in a compartment in the briefcase when the shelves are withdrawn in the briefcase cover portion 16, and the arrangement of the rod guide tubes 76*a*, 76*b* in the cover portion would be unnecessary.

I claim:

1. A handy work briefcase and table system, comprising:

a briefcase including:

a briefcase body portion, and a briefcase cover portion attached to the body portion for relative movement between an open position and a closed position;

a set of extensible legs each mounted at an underside of said body portion for supporting said briefcase a desired height above a floor surface when the legs are set at an extended position;

the body portion of said briefcase having recessed compartments that open at the underside of the body portion for storing said legs in a storage position; and at least one shelf supported in the briefcase cover portion for sliding movement between a retracted position in which the shelf is carried inside said cover portion, and a working position in which the shelf projects out from said briefcase cover portion substantially parallel with a top surface of said cover portion, so that the projecting shelf and the cover portion together define a generally flat table surface when the legs are in the extended position and the cover portion is in the closed position.

2. The briefcase and table system of claim 1, wherein each of said legs is of telescoping construction.

3. The briefcase and table system of claim 2, including a number of rigid leg box means mounted on the underside of said body portion for defining the recessed compartments in which the legs are stored.

4. The briefcase and table system of claim 3, wherein each of the leg box means comprises a generally rectangular leg storage box of rigid sheet material.

5. The briefcase and table system of claim 3, wherein the underside of said briefcase body portion has bottom openings cut for registration with corresponding openings of the leg box means.

6. The briefcase and table system of claim 1, wherein a pair of said legs are mounted for pivotal swinging movement near each of two opposite side end boundaries of said underside, so that each pair of legs extend parallel to one another in an associated recessed compartment when in the storage position, and each leg swings about an axis at an opposite end of the compartment.

7. The briefcase and table system of claim 6, including means at opposite ends of each compartment for limiting the swinging movement of each leg in the direction toward said extended position.

8. The briefcase and table system of claim 7, wherein said limiting means is adapted so that each leg swings through an angle of about 102 degrees when moved between said storage position and said extended position.

9. The briefcase and table system of claim 1, wherein each shelf is formed of rigid sheet material, and including a support rod associated with each shelf so that, when the shelf is in said working position, one end of said rod is fitted to a part of the shelf projected from the briefcase cover portion and the opposite end of said rod is arranged to be placed against at a confronting side of the briefcase body portion, wherein the shelf is supported and maintained parallel with the top surface of said cover portion when a load is placed on the shelf in said working position.

10. The briefcase and table system of claim 9, including face plate means mounted on said confronting side of the briefcase body portion, for seating the opposite end of said support rod in a recess formed in the face plate means.

11. The briefcase and table system of claim 9, wherein each shelf has a lip bending downwardly along an edge furthest from the confronting side of the briefcase body portion when the shelf is in said working position, and said one end of the support rod is loosely fixed to said lip in the long direction of the rod so that the opposite end of the rod can be lowered and placed against said confronting side.

12. The briefcase and table system of claim 9, including a guide tube supported in the briefcase cover portion for receiving and guiding said support rod over a determined path when the opposite end of said support rod is inserted in a front opening of the guide tube in a confronting side of said cover portion, and the corresponding shelf is moved toward said withdrawn position in the cover portion.

13. The briefcase and table system of claim 9, including spring bias means in the cover portion and connected to said shelf for applying a retracting force to said shelf when in the working position, so that said opposite end of the associated support rod is positively seated against the confronting side of said body portion.

* * * * *